US009343832B2

(12) United States Patent
Aoki

(10) Patent No.: US 9,343,832 B2
(45) Date of Patent: May 17, 2016

(54) PLUG CONNECTOR AND METHOD OF MANUFACTURING THE SAME

(71) Applicant: DAI-ICHI SEIKO CO., LTD., Kyoto-shi (JP)

(72) Inventor: Hideki Aoki, Fukuoka (JP)

(73) Assignee: DAI-ICHI SEIKO CO., LTD., Kyoto-shi (JP)

( * ) Notice: Subject to any disclaimer, the term of this patent is extended or adjusted under 35 U.S.C. 154(b) by 0 days.

(21) Appl. No.: 14/283,375

(22) Filed: May 21, 2014

(65) Prior Publication Data

US 2014/0357108 A1 Dec. 4, 2014

(30) Foreign Application Priority Data

May 31, 2013 (JP) ..... 2013-114822

(51) Int. Cl.
*H01R 13/62* (2006.01)
*H01R 12/77* (2011.01)
*H01R 12/79* (2011.01)

(52) U.S. Cl.
CPC ..... *H01R 12/772* (2013.01); *H01R 12/79* (2013.01); *Y10T 29/49147* (2015.01)

(58) Field of Classification Search
CPC .... H01R 13/6581; H01R 12/79; H01R 12/77; H01R 12/88
USPC ..... 439/607.55
See application file for complete search history.

(56) References Cited

U.S. PATENT DOCUMENTS 5,499,927 A 3/1996 Ohno et al.
2002/0192998 A1* 12/2002 Noro ..... H01R 13/6595 439/497

(Continued)

FOREIGN PATENT DOCUMENTS

CN 1392636 A 1/2003
CN 1794518 A 6/2006

(Continued)

OTHER PUBLICATIONS

Office Action issued Feb. 27, 2015 in Korean Patent Application No. 10-2014-0063516.

(Continued)

*Primary Examiner* — Abdullah Riyami
*Assistant Examiner* — Nader J Alhawamdeh
(74) *Attorney, Agent, or Firm* — Oblon, McClelland, Maier & Neustadt, L.L.P.

(57) ABSTRACT

To make it possible to connect a flat signal-transmission medium to a plug connector efficiently and surely with a simple configuration where the number of components are reduced. In a conductive shell having a medium receiving space in which a terminal portion of the flat signal-transmission medium is inserted, a retaining engaging pawl which is engaged with a part of the flat signal-transmission medium inserted into the medium receiving space and holds the flat signal-transmission medium is made to be provided in a manner where elastic displacement is possible, and the retaining engaging pawl is configured to be engaged with a part of the flat signal-transmission medium owing to an elastically returning bias force of the retaining engaging pawl, and thereby, only by inserting the flat signal-transmission medium into the medium receiving space of the conductive shell, the flat signal-transmission medium is held without a backlash in the conductive shell owing to a engagement force of the retaining engaging pawl, and attaching of the flat signal-transmission medium is performed easily and satisfactory.

5 Claims, 14 Drawing Sheets

(56) References Cited

U.S. PATENT DOCUMENTS

| | | | | |
|---|---|---|---|---|
| 2011/0076887 | A1* | 3/2011 | Miyazaki | H01R 12/592 439/607.55 |
| 2011/0177717 | A1* | 7/2011 | Lin | H01R 9/05 439/607.55 |
| 2012/0003866 | A1* | 1/2012 | Yamaji | H01R 13/405 439/527 |
| 2012/0252252 | A1* | 10/2012 | Yamaji | H01R 13/6581 439/310 |
| 2013/0164977 | A1* | 6/2013 | Huang | H01R 13/6581 439/607.01 |

FOREIGN PATENT DOCUMENTS

| | | | | |
|---|---|---|---|---|
| CN | 1934755 | A | 3/2007 | |
| CN | 1956267 | A | 5/2007 | |
| CN | 102142631 | A | 8/2011 | |
| CN | 102195162 | A | 9/2011 | |
| CN | 202183485 | U | 4/2012 | |
| CN | 202564593 | U | 11/2012 | |
| EP | 2365588 | A1 * | 9/2011 | H01R 12/775 |
| EP | 2637257 | A1 * | 9/2013 | H01R 12/774 |
| JP | 2011-119162 | A | 6/2011 | |
| JP | 2011-187367 | | 9/2011 | |
| KR | 10-2011-0102164 | A | 9/2011 | |
| TW | 200820518 | A | 5/2008 | |
| TW | M371991 | U1 | 1/2010 | |
| TW | 201205967 | A | 2/2012 | |

OTHER PUBLICATIONS

Combined Chinese Office Action and Search Report issued Dec. 2, 2015 in Patent Application No. 201410235011.8 (with English translation of categories of cited documents).

Combined Office Action and Search Report issued Oct. 20, 2015 in Taiwanese Patent Application No. 103116216 (with English Translation of Category of Cited Documents).

* cited by examiner

PLUG CONNECTOR AND METHOD OF MANUFACTURING THE SAME

BACKGROUND OF THE INVENTION

1. Field of the Invention

The present invention relates to a plug connector which is configured so that a terminal portion of a flat signal-transmission medium which projects from a conductive shell may be inserted into an opposing connector, and to a method of manufacturing the same.

2. Description of the Related Art

Generally, in various electric appliances or the like, it is performed widely that a terminal portion of various flat signal-transmission mediums formed so as to make a slender plate shape such as a flexible printed circuit (FPC) and a flexible flat cable (FFC) is made to have been connected to a plug connector, and the plug connector where the flat signal-transmission medium is connected is made to be inserted and fitted to a receptacle connector as an opposing connector mounted on a printed wiring board, and thereby, electric connection is performed.

While the plug connector at this time is generally configured so as to cover both the front and back surfaces of an insulating base (insulating housing) with a pair of conductive shells, a connection terminal (contact) with a signal line or a ground line (shielding wire) exposed is formed so as to make a multi-electrode shape electrode part in the terminal portion of the flat signal-transmission medium, and those multi-electrode shape electrode parts are arranged so as to project from the conductive shell.

In the case of performing attaching of the above mentioned plug connector, the terminal portion of the flat signal-transmission medium is attached to the insulating base (insulating housing) first, and after the insulating base which is in a state with this flat signal-transmission medium connected is attached to one conductive shell, the other conductive shell is attached so as to carry out covering from the upper side, and thereby, harness manufacturing is performed. In addition, since the flat signal-transmission medium of this state has a possibility of generating a backlash against the flat signal-transmission medium or the insulating base (insulating housing), a fixed state of the flat signal-transmission medium is secured by using a fixing means such as a tape or the like On the other hand, the present applicant discloses a connector device which does not need the insulating base (insulating housing) in a prior art document described below. However, also in a manufacturing process of the plug connector according to the prior art document described below, at least 3 processes, i.e., a setting process of the flat signal-transmission medium for one conductor-made shell, an attachment process of the other conductive shell, and an adding process of a fixing means are needed, and further enhancement of attachment workability such as performing reduction of the number of processes is required.

Herein, we disclose Japanese Patent Laid-open No. 2011-187367 as a close prior art document to the present invention.

Then, the object of the present invention is to provide a plug connector and a method of manufacturing the same where the flat signal-transmission medium can be connected efficiently and surely in a simple configuration.

SUMMARY OF THE INVENTION

In order to achieve the above-mentioned object, as for the plug connector according to the present invention, it is configured that: in the plug connector which is attached so that a terminal portion of a flat signal-transmission medium may project from a conductive shell and is configured so that a portion including the terminal portion of the flat signal-transmission medium may be inserted into an opposing connector, a medium receiving space in which the terminal portion of the flat signal-transmission medium is inserted is formed in the conductive shell, and a retaining engaging pawl which holds the flat signal-transmission medium by being engaged with a part of the flat signal-transmission medium inserted into the medium receiving space is provided in the conductive shell, and the retaining engaging pawl is supported in a manner where elastic displacement is possible in a direction orthogonal to an insertion direction of the flat signal-transmission medium, and by a part of the flat signal-transmission medium inserted into the medium receiving space abutting on the retaining engaging pawl, the retaining engaging pawl is displaced elastically, and owing to an elastically returning bias force of the retaining engaging pawl at that time, the retaining engaging pawl is engaged with a part of the flat signal-transmission medium.

According to the configuration like this, only by inserting the flat signal-transmission medium into the medium receiving space of the conductive shell, the retaining engaging pawl will be in an engagement state with a part of the flat signal-transmission medium, and the flat signal-transmission medium is held without a backlash against the conductive shell owing to an engagement force of this retaining engaging pawl, and thereby, attaching of the flat signal-transmission medium is performed easily and satisfactory.

In addition, in the conductive shell in the present invention, an abutting elastic spring part which abuts on a part of the flat signal-transmission medium inserted into the medium receiving space of this conductive shell and is displaced elastically in the insertion direction is provided, and the flat signal-transmission medium is preferably configured to be pressed against the retaining engaging pawl side owing to the elastically returning bias force of this abutting elastic spring part.

According to the configuration like this, the abutting elastic spring part and the retaining engaging pawl will be contacted by pressure with each other elastically from the front and rear in the insertion direction of the flat signal-transmission medium, and thereby, retentivity of the flat signal-transmission medium is enhanced.

In addition, in the flat signal-transmission medium in the present invention, a positioning part formed so as to project or become depressed in a plate width direction or a plate thickness direction of this flat signal-transmission medium is provided, and the retaining engaging pawl is preferably configured to be engaged with the positioning part.

According to the configuration like this, engagement of the retaining engaging pawl with the flat signal-transmission medium will be surely performed via the positioning part, and the retentivity of the flat signal-transmission medium is enhanced.

In addition, in the present invention, on a surface of the conductive shell, a short circuit prevention part which holds this conductive shell in a non-contact state with the connection terminal is provided, and this short circuit prevention part is preferably arranged so as to be faced to an insulation portion of the flat signal-transmission medium inserted into the medium receiving space.

According to the configuration like this, when the conductive shell is deformed by an external force or the like, the short circuit prevention part abuts on the insulation portion of the flat signal-transmission medium, and thereby, the conductive shell 11 becomes prevented from being deformed any more, and the conductive shell is prevented from coming in contact with the connection terminal, and thereby, an electrical short of a transmission signal is avoided.

In addition, in the conductive shell in the present invention, a sliding contact elastic spring member which abuts on a side end surface of this flat signal-transmission medium in a plate width direction and bends elastically when the flat signal-transmission medium is inserted is provided preferably.

According to the configuration like this, the flat signal-transmission medium inserted into the medium receiving space of the conductive shell will be moved up to the position determined in advance in the plate width direction owing to an elastic bias force of the sliding contact elastic spring member, and irrespective of the initial state when the flat signal-transmission medium is inserted, this flat signal-transmission medium is configured to be held in an appropriate position in the plate width direction.

In addition, in a manufacturing method of the plug connector according to the present invention, a configuration where two or more bodies of the conductive shells are connected and manufactured integrally is adopted.

According to such manufacturing method, two or more conductive shells will be manufactured in package, and manufacturing efficiency will be enhanced substantially.

The present invention as mentioned above is configured so that in a conductive shell having a medium receiving space in which a terminal portion of the flat signal-transmission medium is inserted, a retaining engaging pawl which is engaged with a part of the flat signal-transmission medium inserted into the medium receiving space and holds this flat signal-transmission medium is made to be provided in a manner where elastic displacement is possible, and owing to an elastically returning bias force of the retaining engaging pawl, the retaining engaging pawl is configured to be engaged with a part of the flat signal-transmission medium, and thereby, only by inserting the flat signal-transmission medium into the medium receiving space of the conductive shell, the flat signal-transmission medium is held without a backlash in the conductive shell owing to a engagement force of the retaining engaging pawl, and attaching of the flat signal-transmission medium is performed easily and satisfactory. Therefore, the flat signal-transmission medium can be connected to the plug connector efficiently and surely with a simple configuration where the number of components is reduced, and productivity and reliability of an electrical connector can be enhanced substantially at low cost.

DETAILED DESCRIPTION OF THE PREFERRED EMBODIMENTS

Hereafter, an embodiment of the present invention will be described in detail based on drawings.

[With Respect to Electrical Connector Assembly]

Figure 1:
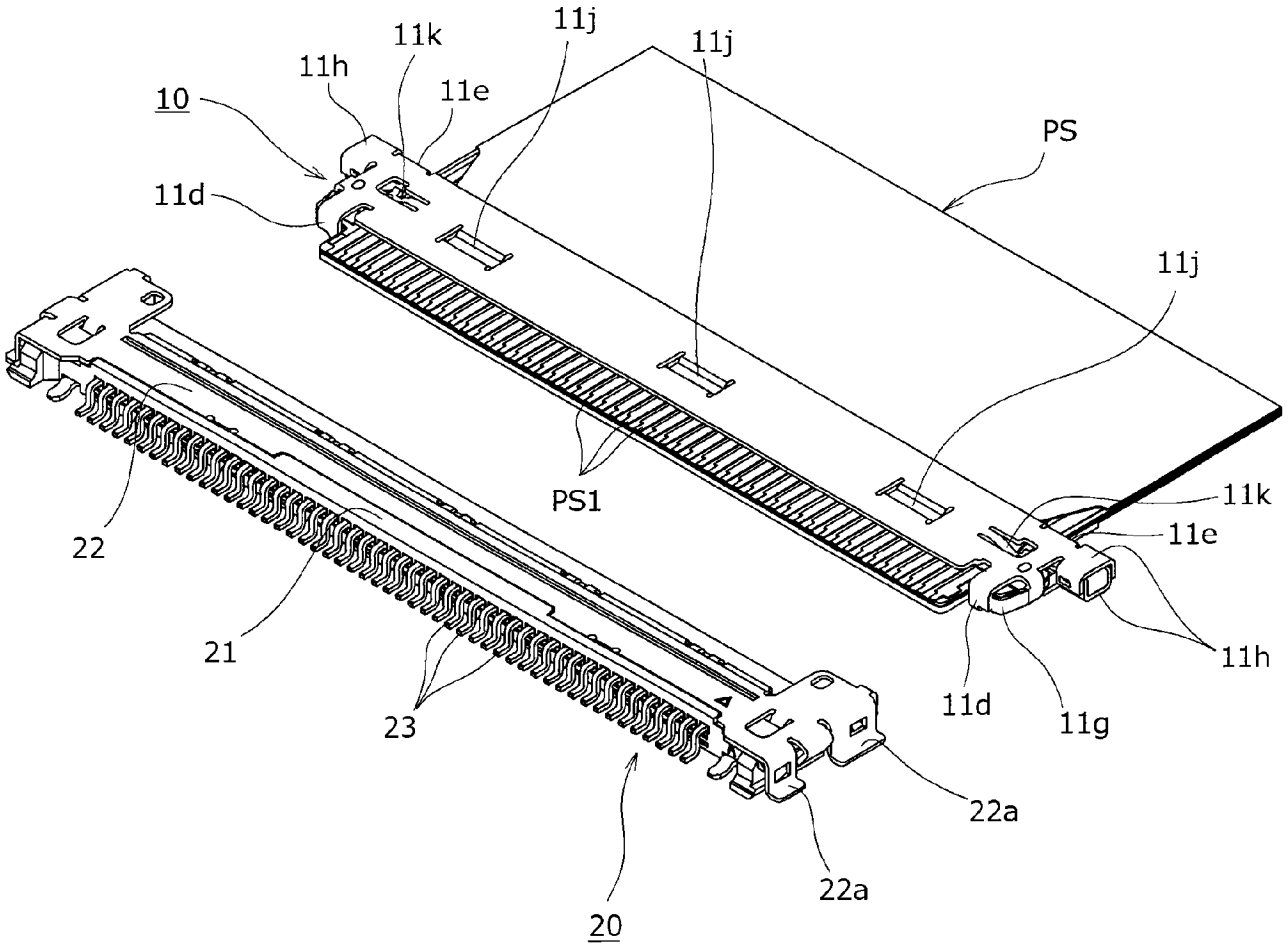
FIG. 1 is an external perspective explanatory view illustrating a state where a plug connector according to an embodiment of the present invention with a flat signal-transmission medium (FPC, FFC) inserted is made to be close to a receptacle connector as an opposing connector.
Figure 2:
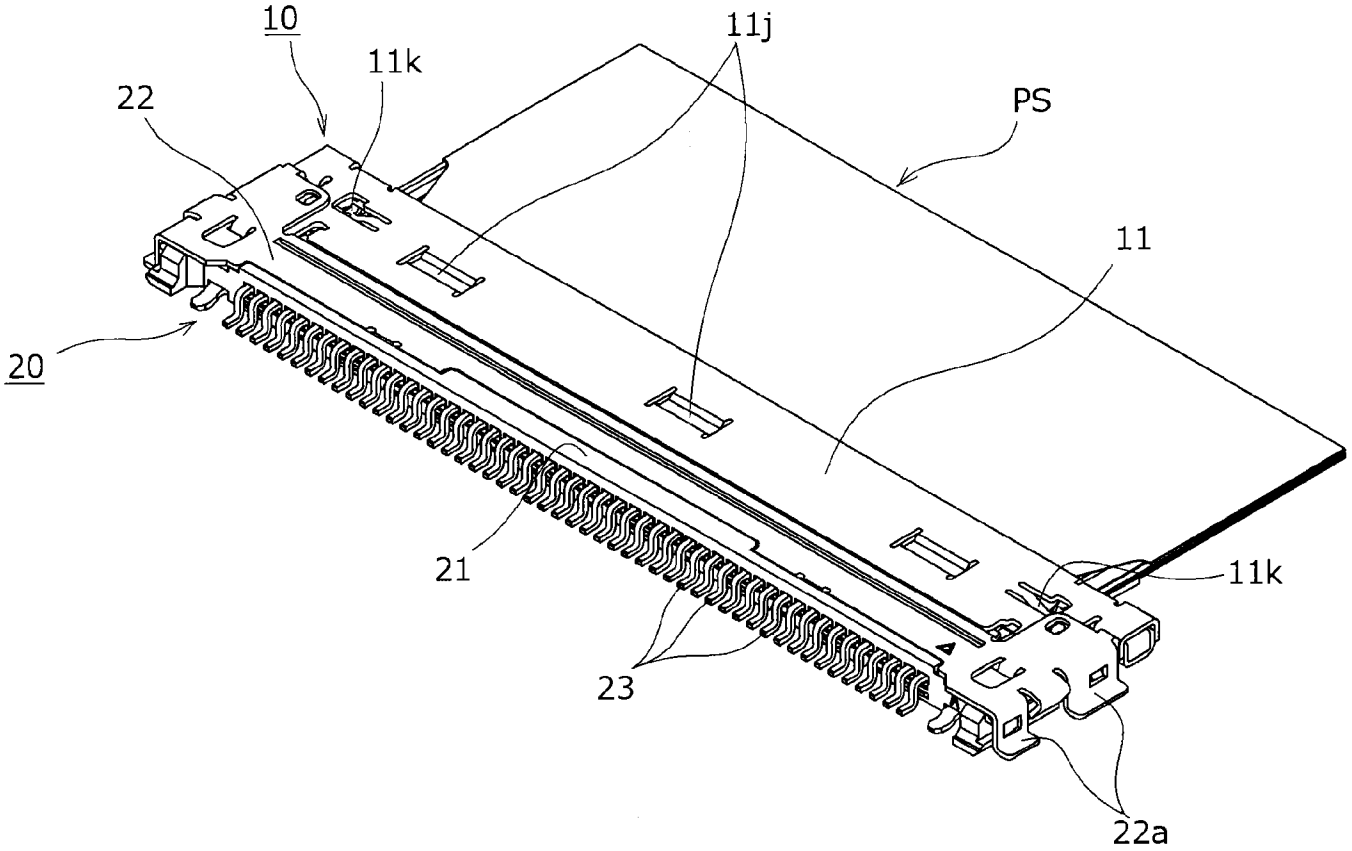
FIG. 2 is an external perspective explanatory view illustrating a state where the plug connector is made to be inserted and fitted to the receptacle connector from the state of FIG. 1.

An electrical connector assembly according to an embodiment of the present invention illustrated in FIGS. 1 to 14 is one which is used for connecting a terminal portion of a flat signal-transmission medium PS made up of a flexible printed circuit (FPC) and a flexible flat cable (FFC) or the like to an electronic circuit on a printed wiring board whose illustration is omitted, and a plug connector 10 according to an embodiment of the present invention where a terminal portion of the flat signal-transmission medium PS is connected as illustrated in particular in FIG. 2, is inserted in an approximately horizontal direction into a receptacle connector 20 as an opposing connector connected by soldering to a wiring pattern (illustration omitted) formed on the printed wiring board, and thereby, is made to be in a fitted state.

In the following, an extending direction of a surface of the printed wiring board is assumed to be a "horizontal direction", and a direction perpendicular to the surface of the printed wiring board is assumed to be a "height direction". In addition, in the plug connector 10, an end edge part of a tip side in an inserting direction at the time of fitting is assumed to be a "front end edge part", and an end edge part in the side in the opposite side thereto where the terminal portion of the flat signal-transmission medium PS is connected is assumed to be a "rear end edge part". In addition, in the receptacle connector 20, an end edge part in the side where the plug connector 10 is inserted at the time of fitting is assumed to a "front end edge part", and an end edge part in the opposite side is assumed to be a "rear end edge part". In addition, the plug connector 10 and receptacle connector 20 have a connector body part extending so as to make an elongated shape, and an extending direction of the connector body part is referred to as a "connector longitudinal direction".

In addition, the flat signal-transmission medium (FPC, FFC) PS extending from the rear end edge part of the plug connector 10 to a rear side thereof is connected while the above mentioned "connector longitudinal direction" is assumed to a "plate width direction", and is made up of a member extending in a direction perpendicular to the "plate width direction", and two or more signal lines and ground lines (shielding wire) are arranged adjacently so as to make a multi-electrode shape along the "plate width direction".

[With Respect to Plug Connector]

Figure 3:
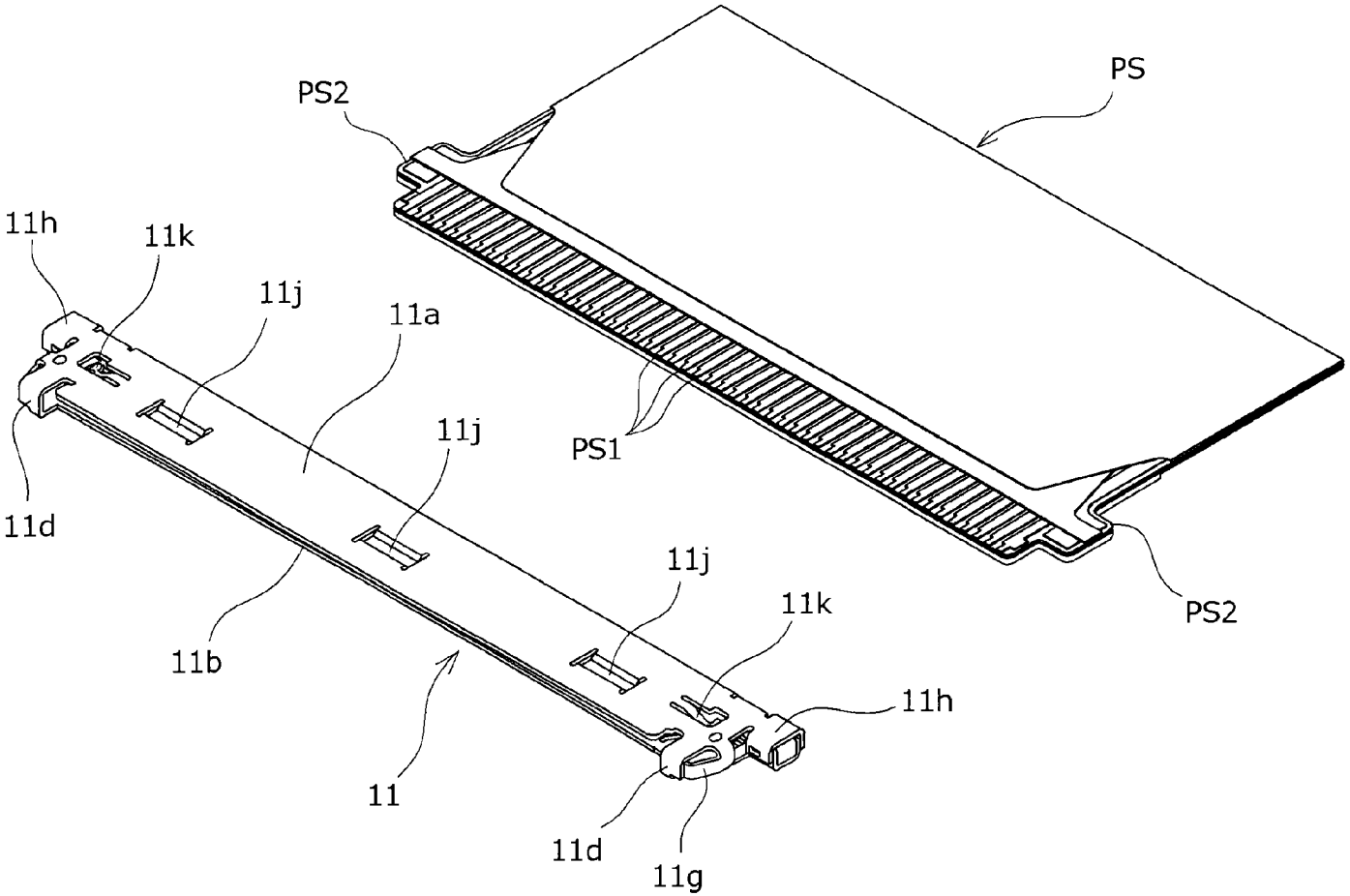
FIG. 3 is an external perspective explanatory view illustrating a state where the flat signal-transmission medium (FPC, FFC) is removed from the plug connector according to an embodiment of the present invention illustrated in FIGS. 1 and 2.

The connector body part of the plug connector 10 constituting the electrical connector of one side of the electrical connector assembly like this does not have an insulating base (insulating housing) made up of insulating materials such as synthetic resin with which a general electrical connector is provided, and is made to be a configuration where the terminal portion of the flat signal-transmission medium (FPC, FFC) PS is inserted and fixed within a medium receiving space formed in the inside of a conductive shell 11 for blocking off an electromagnetic wave noise or the like. The conductive shell 11 at this time, as illustrated in FIG. 3, is formed by an integral structure provided with an upper shell 11*a* and lower shell 11*b* which sandwich the terminal portion of the flat signal-transmission medium PS from the upper and lower sides, and the detailed structure will be described in the latter part.

Figure 8:
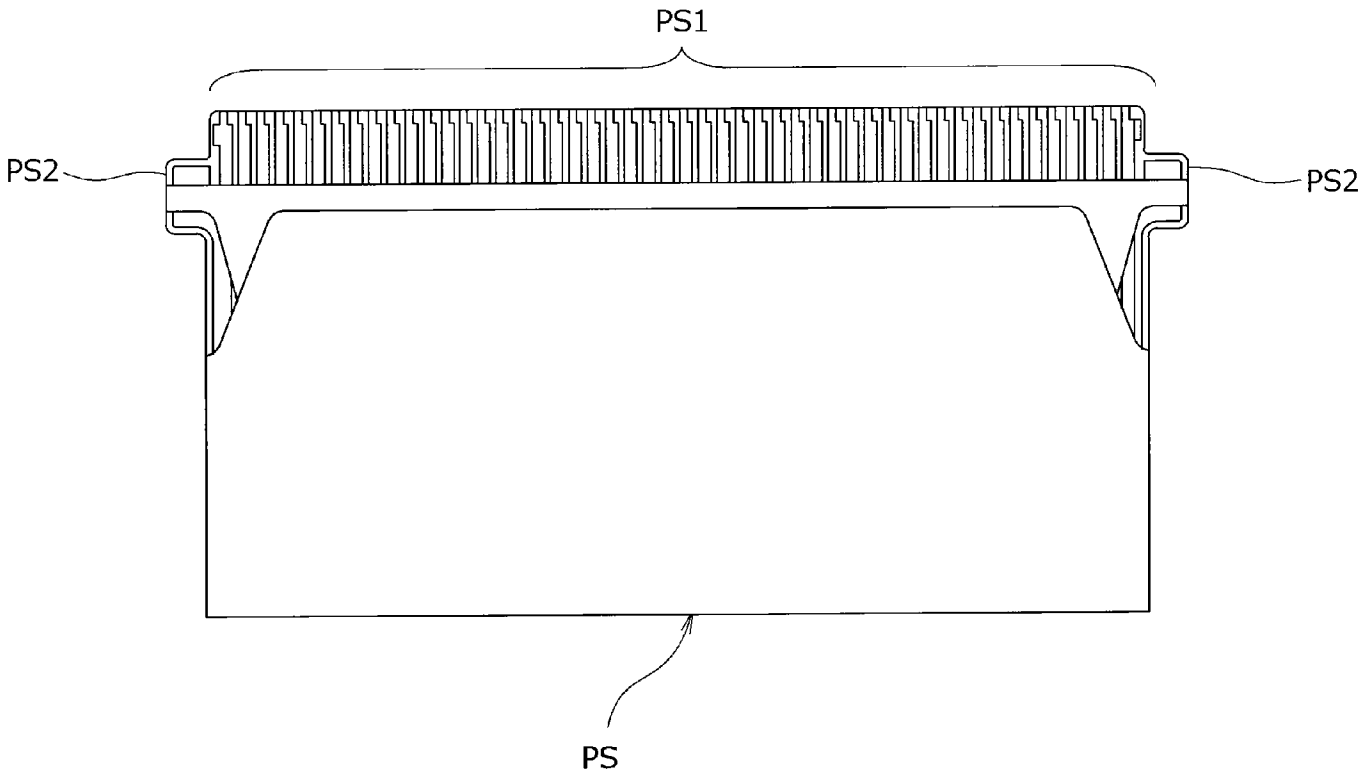
FIG. 8 illustrates a plane explanatory view of the flat signal-transmission medium (FPC, FFC) single body.
Figure 9:
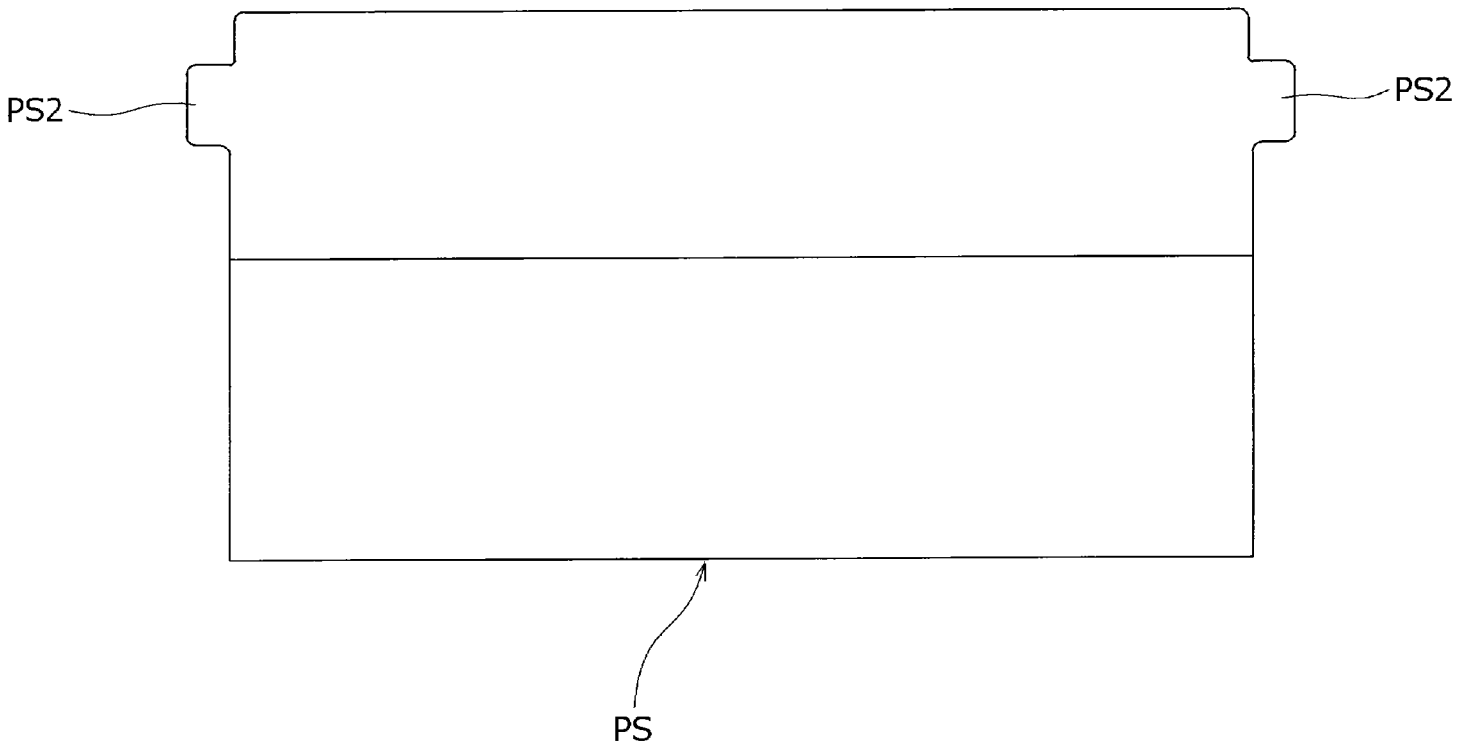
FIG. 9 illustrates a bottom explanatory view of the flat signal-transmission medium (FPC, FFC) single body.

On the other hand, as illustrated to FIGS. 8 and 9, as for the flat signal-transmission medium (FPC, FFC) PS, two or more signal lines and ground lines are arranged along the plate width direction so as to make a multi-electrode shape in the inside of an insulating sheath material having flexibility as described above, and the insulating sheath member in the present embodiment is made to be a structure where an insulating cover film stuck so as to form a lower layer on the above mentioned signal lines and ground lines is used, and at the same time, a shield tape is laminated further on the insulating cover film so as to constitute an upper layer.

Then, the insulating sheath member like this is made to be in a state where the insulating sheath member is removed in a fixed area at a tip edge side inserted into the medium receiving space of the plug connector 10, and thereby, an electrode part having the multi-electrode shape is formed. That is, the terminal portion of this flat signal-transmission medium PS is made to be in a state where two or more signal lines and ground lines are exposed to the upper side, and a multi-electrode shape electrode part made up of two or more connection terminal parts (contact part) PS1 is formed by the exposed portion of the signal line and ground line. Note that, on an underside portion (non-exposing side portion) of these connection terminal parts PS1, an insulating sheath material is laminated so as to cover the whole underside of the connection terminal parts PS1.

At this time, the connection terminal part PS1 in the present embodiment is provided with a ground terminal where a ground line is exposed in both-side portions in the plate width direction, and between the both ground terminals in the both-side portions in the plate width direction, a signal line terminal formed by exposing the signal line is arranged so as to make a prescribed pitch. The terminal portion of the flat signal-transmission medium (FPC, FFC) PS having two or more connection terminal parts PS1 like this is inserted into the inside of the above mentioned conductive shell 11 and fixed therein, and in a fixed state of this flat signal-transmission medium PS, the connection terminal part (multi-electrode shape electrode part) PS1 is arranged so as to project toward the front of the front end edge of the conductive shell 11, and is configured to be inserted into the receptacle connector 20 as an opposing connector mentioned later and connected electrically.

In addition, in the both-side edges in the plate width direction of the flat signal-transmission medium (FPC, FFC) PS, positioning parts PS2 and PS2 are provided at portions corresponding to the slightly backward side of the above mentioned connection terminal part (multi-electrode shape electrode part) PS1. Each of these positioning parts PS2 is formed so as to project in the outward of the plate width direction in a planar and approximately rectangular shape, and the above mentioned ground terminal is formed on the upper surface of each of the positioning parts PS2. Apart of the ground terminal is covered with the insulating cover film constituting the lower layer of the insulating sheath member, and the shield tape constituting the upper layer is made to be formed in a shape where the positioning part PS2 is not covered while the both-side portions in the connector longitudinal direction are cut in a corner shape. In addition, a configuration where retaining engaging pawls 11*c* and 11*c* provided in the conductive shell 11 are engaged with each of these positioning parts PS2 as described later is made to be formed, and those retaining engaging pawls 11*c* and 11*c* are engaged with the positioning part PS2 and PS2 respectively, and thereby, the whole flat signal-transmission medium PS is configured to be held at a prescribed position determined in advance.

Figure 5:
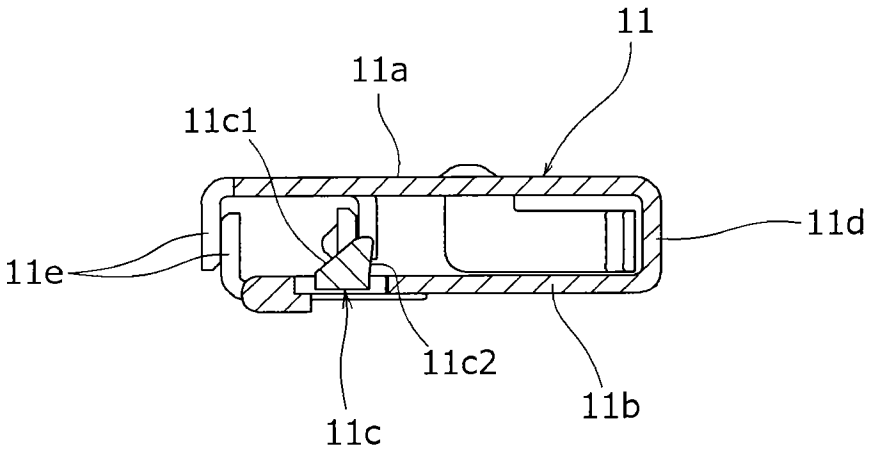
FIG. 5 illustrates a cross section explanatory view of the single body of the plug connector along a V-V line in FIG. 4.

When this point is described in detail, the conductive shell 11, as described above, is made up of the upper shell 11*a* and lower shell 11*b* which sandwich the terminal portion of the flat signal-transmission medium (FPC, FFC) PS from the upper and lower sides as illustrated in FIG. 3 and FIG. 5, and front end edge portions of those upper shell 11*a* and lower shell 11*b* are connected integrally by a pair of shell connecting parts 11*d* and 11*d* arranged at both-side portions in the connector longitudinal direction. The shell connecting parts 11*d* and 11*d* are formed by bending a band plate shape member so that the side surface may make an approximate U-shape, and the upper shell 11*a* and lower shell 11*b* connected integrally via the shell connecting parts 11*d* and 11*d* are arranged approximately in parallel in a prescribed interspace. In a parallel facing portion between both upper shell 11*a* and lower shell 11*b*, the medium receiving space for the flat signal-transmission medium PS to be inserted is formed.

The above mentioned shell connecting parts 11*d* and 11*d* are arranged at a front end side portion of the conductive shell 11, that is, both-side portions in the end edge of the side where inserting the flat signal-transmission medium (FPC, FFC) PS into the above mentioned medium receiving space is completed, and in the portion between both the shell connecting parts 11*d* and 11*d*, a projected opening where the connection terminal part PS1 of the flat signal-transmission medium PS penetrates is formed so as to extend in an elongated shape in the connector longitudinal direction. In addition, in the portion which is opposed to the opposite side to the projected opening provided in this conductive shell 11, that is, in the portion of the rear end side in the medium receiving space, an insertion opening where the whole plate width of the flat signal-transmission medium PS including each of the positioning parts PS2 and PS2 of this flat signal-transmission medium PS can be inserted is formed so as to extend in an elongated shape in the connector longitudinal direction. Then, the connection terminal part PS1 of the flat signal-transmission medium PS is going to be inserted in the medium receiving space through the insertion opening of the rear side in the conductive shell 11, and thereafter, is further inserted toward the front side, and thereby, the connection terminal part PS1 of this flat signal-transmission medium PS projects so as to project toward the front side through the above mentioned projected opening, and the terminal portion including each of the positioning parts PS2 and PS2 of the flat signal-transmission medium PS is configured to be received in the medium receiving space.

Figure 4:
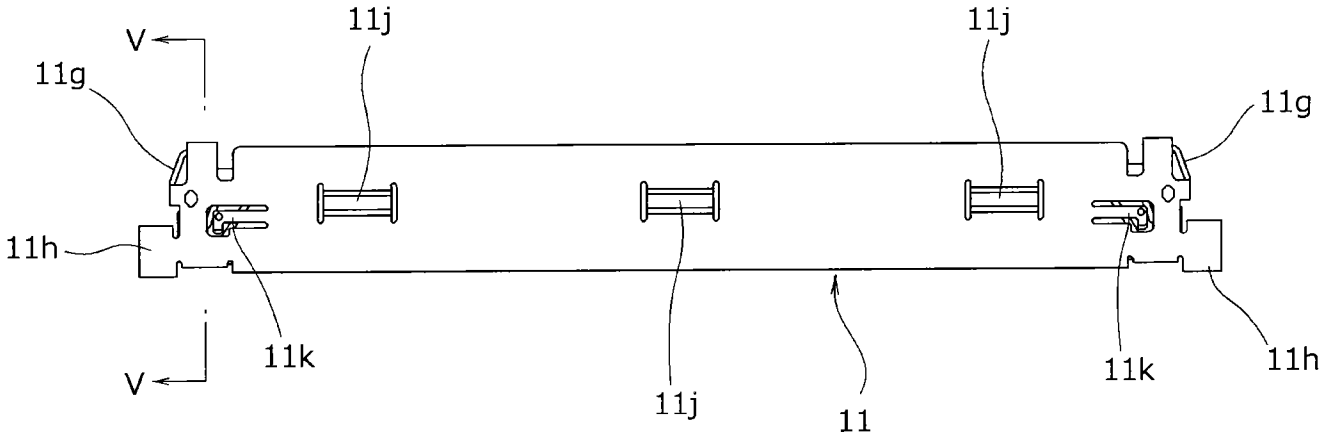
FIG. 4 illustrates a plane explanatory view of the plug connector single body according to FIG. 3 with the flat signal-transmission medium (FPC, FFC) removed.

In addition, as illustrated in FIGS. 4 and 5, in both-side outer portions in the connector longitudinal direction in the projected opening of the above mentioned conductive shell 11, outer fixing parts 11*h* and 11*h* are formed so as to project outward, and by those outer fixing parts 11*h* and 11*h* being fitted vertically, the upper shell 11*a* and lower shell 11*b* are configured to be fixed firmly. That is, in the portion from the outer fixing parts 11*h* and 11*h* up to the projected opening, shell fixing pieces 11*e* and 11*e* are formed by bending front end portions of the upper shell 11*a* and lower shell 11*b* so that the side surface may make approximate L-shape, and among those shell fixing pieces 11*e* and 11*e*, one which is provided in the upper shell 11*a* side and one which is provided in the lower shell 11*b* side are firmly fixed so as to be overlapped mutually in a connector front-back direction. Note that, in a space between the outer fixing parts 11*h* and 11*h* of the upper shell 11*a* and lower shell 11*b*, an axis end of a locking bar which maintains a connected state after the plug connector 10 is connected with the receptacle connector 20 can be held.

Figure 6:
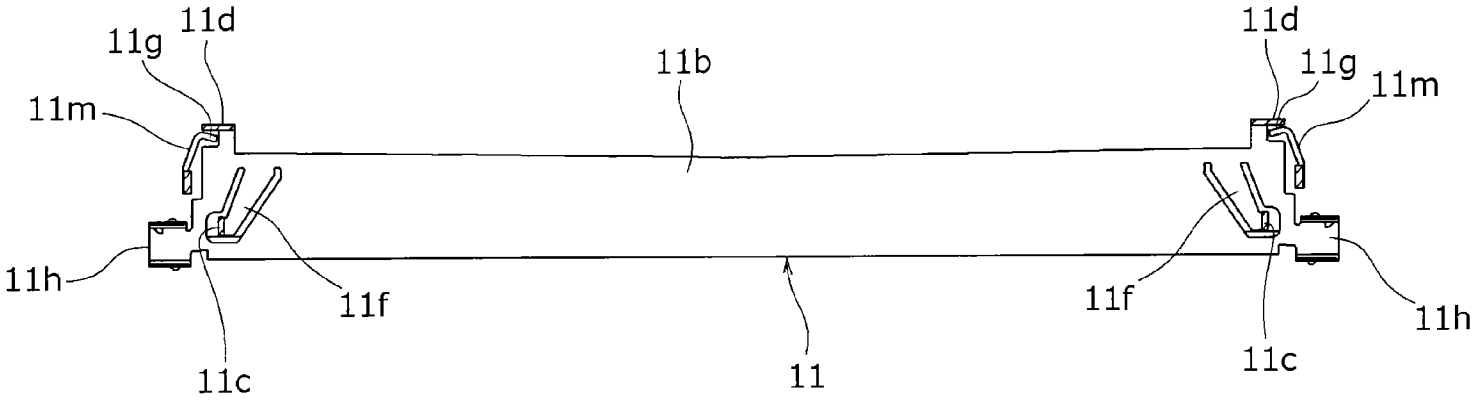
FIG. 6 illustrates a bottom explanatory view in a state where an upper shell is removed in the plug connector single body according to FIG. 3.
Figure 7:
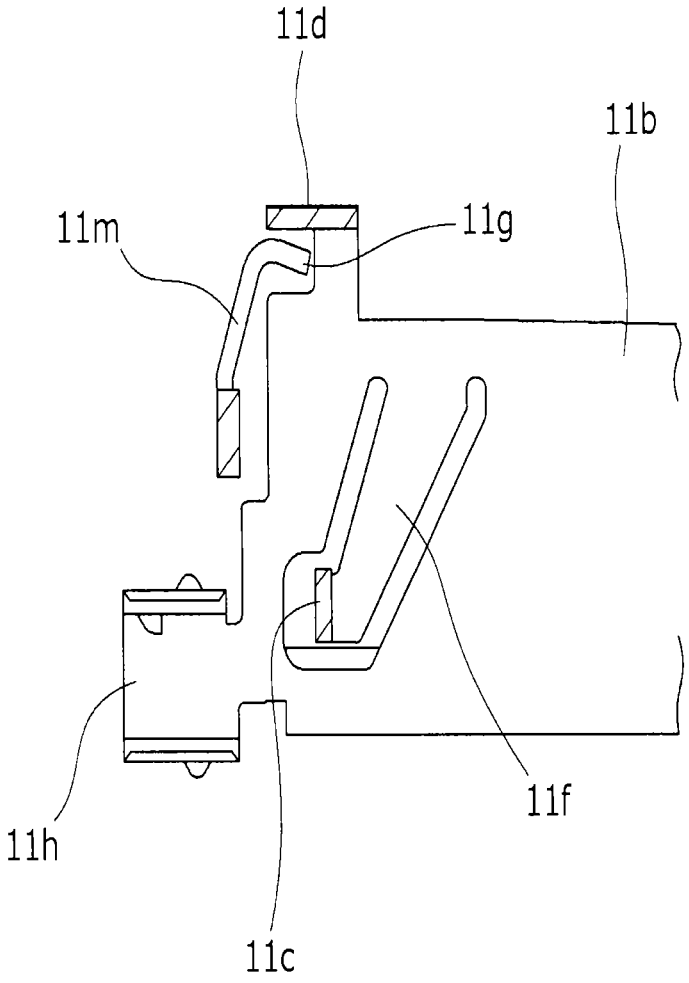
FIG. 7 illustrates a bottom explanatory view with a left end side portion of FIG. 6 expanded in the bottom of the plug connector single body illustrated in FIG. 6.

In addition, as illustrated in FIGS. 5 to 7, at both-side portions in the connector longitudinal direction in the lower shell 11*b*, a pair of retaining engaging pawls 11*c* and 11*c* are formed integrally. These retaining engaging pawls 11*c* and 11*c*, together with elastic arms 11*f* and 11*f* which support this retaining engaging pawls 11*c* and 11*c*, are formed so that a part of the lower shell 11*b* may be punched out. Each elastic arm 11*f* at this time is formed so as to extend in a cantilevered shape toward the front side from a front end edge vicinity portion of the lower shell 11*b*, and the retaining engaging pawls 11*c* are each formed at a free end edge portion of each of those elastic arms 11*f*.

More specifically, the above mentioned each elastic arm 11*f*, while being formed so as to have a root part of the cantilever structure in the front end edge side of the lower shell 11*b*, is made to be a shape extended toward an obliquely outward direction while the plate width contracts continuously toward the rear direction from the root part. Then, the free end edge portion which is an extended side tip portion of this elastic arm 11*f* is bent at an approximately right angle so as to be risen upward, and thereby, formation working of the above mentioned each retaining engaging pawl 11*c* is performed. Each of these retaining engaging pawls 11*c*, as illustrated in FIG. 5 in particular, is formed so as to make an approximately triangular shape in a side view, and has an inclined guide side part 11*c*1 which becomes high continuously from the front side toward the rear side, and a straight shape holding side part 11*c*2 which descends in an approximately straight shape toward the lower part from the top part of the inclined guide side part 11*c*1.

Figure 11:
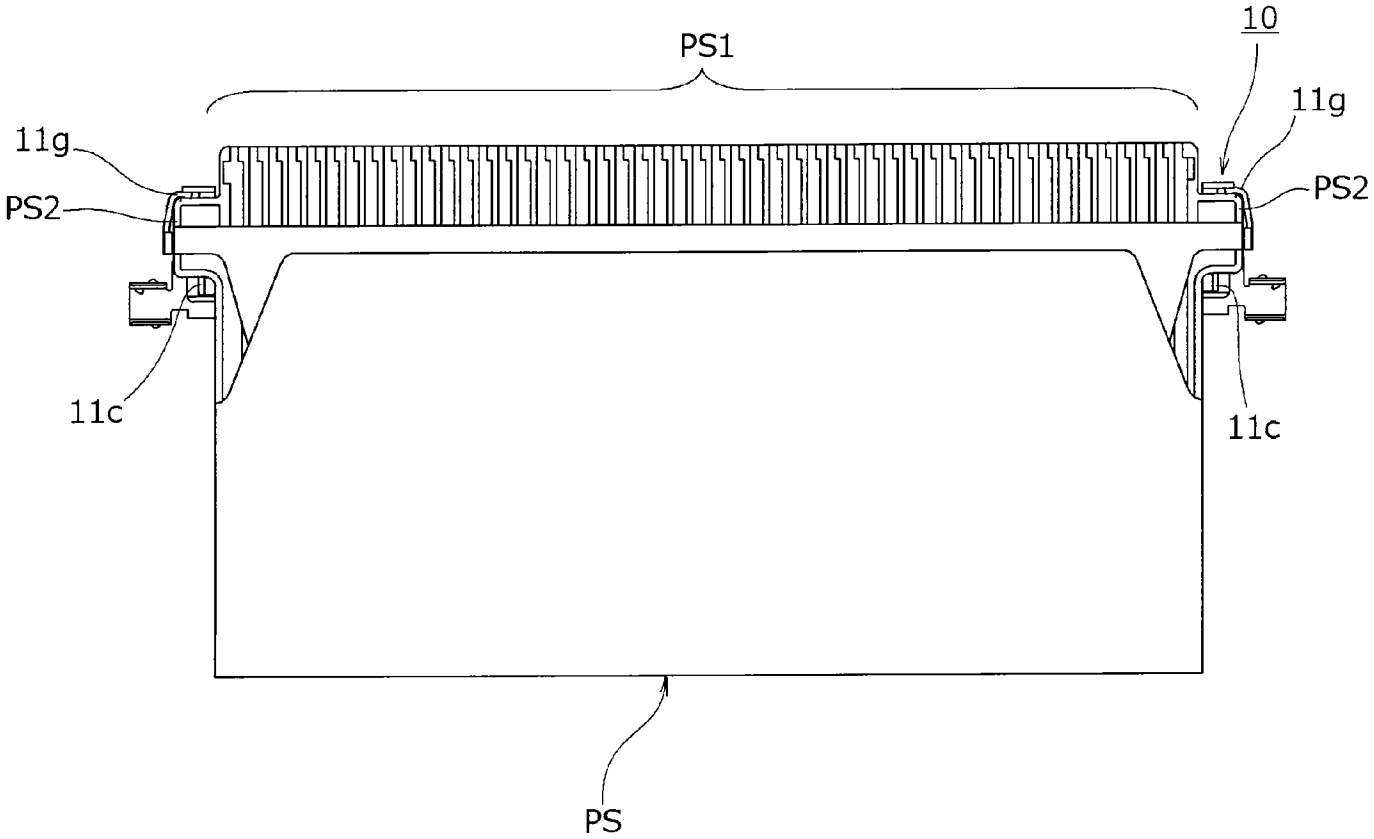
FIG. 11 is a plane explanatory view illustrating a state where the upper shell is removed in the plug connector illustrated in FIG. 10.
Figure 12:
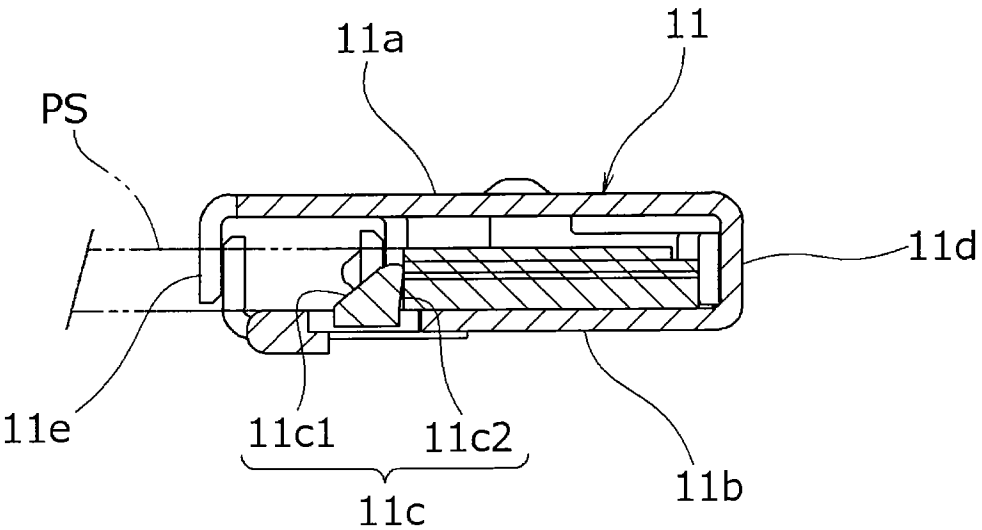
FIG. 12 illustrates a cross section explanatory view along a XII-XII line in FIG. 10.
Figure 14:
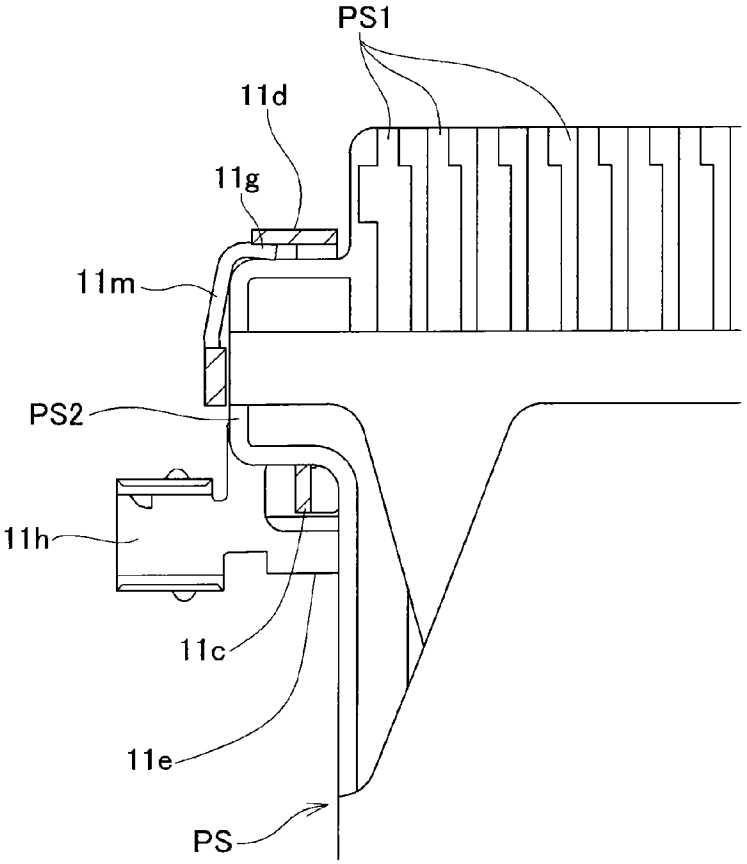
FIG. 14 illustrates a partial plane explanatory view with a left end side portion in FIG. 11 expanded in the plane of the plug connector illustrated in FIG. 11.

The inclined guide side part 11*c*1 of each of those retaining engaging pawls 11*c*, as described above, is made to be in a positional relation capable of abutting on the positioning part PS2 of the flat signal-transmission medium (FPC, FFC) PS inserted from the insertion opening of the conductive shell 11. That is, as illustrated in FIGS. 11 and 12, and FIG. 14, when a insertion direction tip edge part in the positioning part PS2 of the flat signal-transmission medium PS abuts on the inclined guide side part 11*c*1 of the retaining engaging pawl 11*c*, the whole retaining engaging pawl 11*c* is displaced in a descending direction against an elastic force of the above mentioned elastic arm 11*f* owing to a downward component force generated in this inclined guide side part 11*c*1, and a lower side surface of the flat signal-transmission medium PS is formed so as to run on the top part of the retaining engaging pawl 11*c*. The insertion of the flat signal-transmission medium PS progresses further, and at the time when the rear end edge part of the positioning part PS2 of this flat signal-transmission medium PS passes through the retaining engaging pawl 11*c*, the retaining engaging pawl 11*c* is displaced so as to rise up to the original position owing to an elastically returning bias force of the elastic arm 11*f*, and thereby, the straight shape holding side part 11*c*2 of the retaining engaging pawl 11*c* abuts on the rear end edge part of the positioning part PS2 of the flat signal-transmission medium PS, and thereby, is made to be in an engaged state.

On the other hand, as illustrated in FIGS. 6 and 7, in an inner wall vicinity portion of the shell connecting parts 11*d* and 11*d* of the above mentioned conductive shell 11, abutting elastic spring parts 11*g* and 11*g* on the flat signal-transmission medium (FPC, FFC) PS inserted from the insertion opening of the conductive shell 11 are arranged. Each of these abutting elastic spring part 11*g* is formed of the band plate shape member extending via a sliding contact elastic spring 11*m* provided in both end portions in the connector longitudinal direction of the lower shell 11*b*, and extends so as to be along a contour shape which the positioning part PS2 of the flat signal-transmission medium PS has.

More specifically, first, the sliding contact elastic spring 11*m* is formed of a cantilevered shape member extended toward an obliquely forward direction while both end edge parts in the connector longitudinal direction of the lower shell 11*b* is made to be a base thereof, and is extended toward an obliquely forward direction toward a connector inward side (connector center side) from the base. Then, as described above, a positional relation is made to be configured where when the insertion of the flat signal-transmission medium (FPC, FFC) PS is performed, a corner part of an insertion direction front end side of the positioning part PS2 provided in this flat signal-transmission medium PS abuts on the half-way portion of the above mentioned sliding contact elastic spring 11*m*.

In addition, the abutting elastic spring part 11*g* is extended in a cantilevered shape so as to be bent from a tip part in an extending direction of the sliding contact elastic spring 11*m* toward the connector inward side (connector center side), and is formed so as to extend along the front end edge in the connector longitudinal direction with respect to the positioning part PS2 of the flat signal-transmission medium (FPC, FFC) PS inserted up to the final insertion point as illustrated in FIGS. 11 and 14. The sliding contact elastic spring 11*m* and the abutting elastic spring part 11*g* as described above extend so as to be along the front end corner part and the front end edge part of the positioning part PS2 of the above mentioned flat signal-transmission medium PS, respectively, and are made to be a flat-spring shaped member having elastic flexibility by being formed of the cantilevered shape member.

Then, when the flat signal-transmission medium (FPC, FFC) PS is inserted into the medium receiving space, the front end corner part of the positioning part PS2 of the flat signal-transmission medium PS abuts on the sliding contact elastic spring 11*m* first, and the whole flat signal-transmission medium PS including the positioning part PS2 is configured to be moved up to the position determined in advance in the plate width direction owing to the elastic bias force of this sliding contact elastic spring member 11*m*.

In addition, when the flat signal-transmission medium (FPC, FFC) PS is inserted up to the final insertion point of the medium receiving space, the front side end of the positioning part PS2 abuts on the above mentioned abutting elastic spring part 11*g* from the front side, and owing to the elastically returning bias force of this abutting elastic spring part 11*g*, the positioning part PS2 is forced back to the rear side. As the result, the rear side end edge part of the positioning part PS2 is made to be pressed against the straight shape holding side part 11*c*2 of the above mentioned retaining engaging pawl 11*c*.

Figure 10:
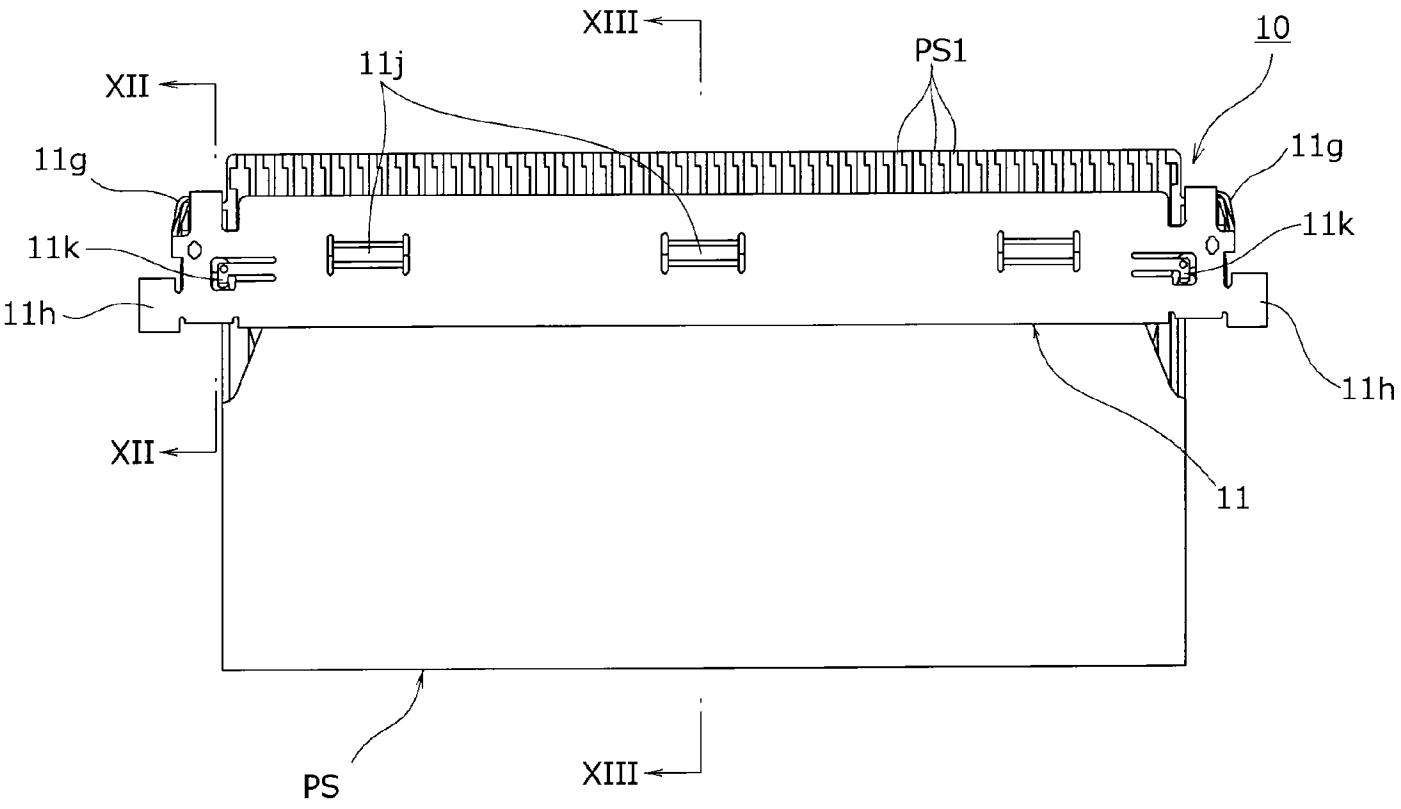
FIG. 10 illustrates the plug connector according to an embodiment of the present invention illustrated in FIGS. 1 and 2 and is a plane explanatory view illustrating a state where the flat signal-transmission medium (FPC, FFC) is inserted and attached.
Figure 13:
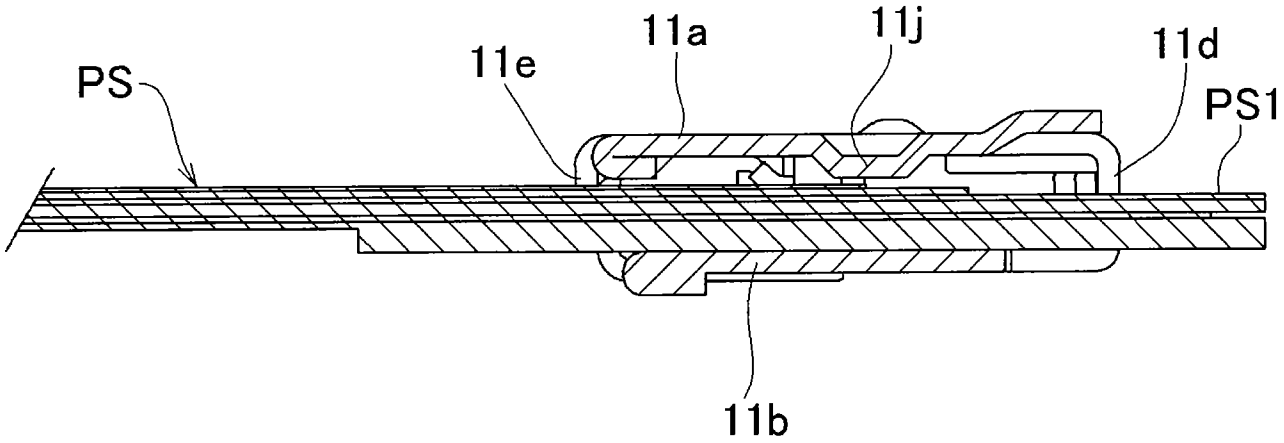
FIG. 13 illustrates a cross section explanatory view along a XIII-XIII line in FIG. 10.

In addition, as illustrated in FIGS. 10 and 13, in the upper shell 11*a* in the conductive shell 11, a short circuit prevention part 11*j* which holds the conductive shell 11 from the connection terminal part PS1 in a non-contact state is provided on the surface of this upper shell 11*a* so that the three bodies may be provided to be in parallel along the connector longitudinal direction. Each of these short circuit prevention parts 11*j* is formed of an inward projected part where press working has been carried out so as to project from the upper shell 11*a* of the conductive shell 11 toward the inside of the medium receiving space, and is provided so that this each short circuit prevention part 11*j* may be opposed from the upper side to an insulating sheath portion of the flat signal-transmission medium (FPC, FFC) PS inserted to the final position in the medium receiving space.

Furthermore, on the upper shell 11*a*, a pair of ground contacts 11*k* and 11*k* are formed at the outer portion in the connector longitudinal direction of the above mentioned short circuit prevention part 11*j*. Each of those ground contacts 11*k* is formed in a cutout shape so as to be projected in a cantilevered shape toward the medium receiving space in the inward side from the upper shell 11*a*. Each of these ground contacts 11*k* is made to have an arrangement relation where the ground contact 11*k* comes in contact with the ground terminal of the flat signal-transmission medium (FPC, FFC) PS, and is configured so that ground connection may be performed when the flat signal-transmission medium PS is inserted up to the final position.

[With Respect to Receptacle Connector]

On the other hand, the receptacle connector 20 constituting the opposing connector of the other side in the electrical connector assembly, as illustrated in FIGS. 1 and 2 in particular, has an insulating housing 21 formed from the insulating material such as synthetic resin, and at the same time, is provided with a conductive shell 22 which covers the exterior surface of the insulating housing 21 and blocks off the electromagnetic wave noise or the like from the outside.

In the insulating housing 21, two or more electric conduction contacts 23 are arranged in a suitable pitch interval so as to make a multi-electrode shape along the connector longitudinal direction. Each of those electric conduction contacts 23 is formed with a beam-shaped elastic metallic material bent, and is arranged so as to be extended in a front-back direction inside a groove portion provided in the above mentioned insulating housing 21. Each of these electric conduction contacts 23 is formed so that adjoining ones may make approximately the same shape.

On the other hand, at a rear end side portion of each of the electric conduction contacts 23, provided is a connecting leg part where bending formation is carried out so as to make a step shape downwardly, and the connecting leg part is joined by soldering and connected electrically to a printed wiring pattern (electrically-conducting path) for signal transmission formed on the printed wiring board whose illustration is omitted. The joining by soldering at this time is performed integrally for all the connecting leg part in a multi-electrode arrangement direction.

In addition, at the front end side portion of the above mentioned each electric conduction contact 23, a contact point part whose illustration is omitted is provided, and each of those contact point parts is made to be in an arrangement relation where the each contact point part is made to come into contact elastically from the upper side with each connection terminal of the connection terminal part PS1 of the plug connector 10 fitted to the receptacle connector 20, and thereby, a signal transmission circuit which reaches the printed wiring board via the connecting leg part from the contact point part is configured to be formed.

In addition, while the conductive shell 22, in the upper front end edge part and lower front end edge part thereof, is configured to come into surface contact elastically with the upper surface portion of upper shell 11*a* and the lower surface portion of lower shell 11*b* of the plug connector 10 fitted to this receptacle connector 20, two or more holddowns 22*a* are provided so as to be extended approximately horizontally toward the outward side and rear end side in the connector longitudinal direction at both end portions in the connector longitudinal direction in the conductive shell 22. These holddowns 22*a* are joined by soldering and connected electrically to the printed wiring pattern (electrically-conducting path) for grounding formed on the printed wiring board, and thereby, a ground circuit which reaches the printed wiring board from the conductive shell 22 is formed, and at the same time, the whole receptacle connector 20 is configured to be fixed.

In the plug connector 10 according to the embodiment like this, when the flat signal-transmission medium (FPC, FFC) PS is inserted into the medium receiving space through the insertion opening provided in the rear end of the conductive shell 11, the positioning part PS2 of the flat signal-transmission medium PS abuts on the retaining engaging pawl 11*c*. The retaining engaging pawl 11*c* is displaced downward and the lower surface side of the flat signal-transmission medium PS runs on the retaining engaging pawl 11*c*, and after that, the retaining engaging pawl 11*c* is risen up and displaced up to the original position and comes back elastically, and thereby, the straight shape holding side part 11*c*2 of the retaining engaging pawl 11*c* comes, from the rear side, into the state of engagement with the positioning part PS2 of the flat signal-transmission medium PS. As the result, the flat signal-transmission medium PS will be held without a backlash against the conductive shell 11, and attaching of this flat signal-transmission medium PS is performed easily and satisfactory only by inserting of the flat signal-transmission medium PS.

In particular, in the present embodiment, the positioning part PS2 of the flat signal-transmission medium (FPC, FFC) PS is configured to be pressed against the retaining engaging pawl 11*c* of the rear side owing to the pressing-back bias force of the abutting elastic spring part 11*g*, and thereby, the flat signal-transmission medium PS is made to be elastically in the press contact state from the front and rear of insertion direction and is held surely, and the retentivity of this flat signal-transmission medium PS is configured to be enhanced. In the present embodiment as described above, the engagement of the retaining engaging pawl 11*c* with the flat signal-transmission medium PS is performed surely via the positioning part PS2, and thereby, the retentivity of the flat signal-transmission medium PS is configured to be enhanced.

In addition, in the present embodiment, when the conductive shell 11 is going to be deformed with an external force or the like applied, the short circuit prevention part 11*j* abuts on the insulating sheath portion of the flat signal-transmission medium (FPC, FFC) PS, and the conductive shell 11 becomes prevented from being deformed any more, and the conductive shell 11 becomes prevented from coming into contact with the connection terminal part (multi-electrode shape electrode part) PS1 of the conductive shell 11, and non-conformities such as a electrical short of a transmission signal are configured to be avoided satisfactory.

Furthermore, in the present embodiment, the flat signal-transmission medium (FPC, FFC) PS inserted into the medium receiving space of the conductive shell 11 is moved up to the position determined in advance in the plate width direction owing to the elastic bias force of the sliding contact elastic spring 11*m*, and thereby, this flat signal-transmission medium is held in an appropriate position in the plate width direction irrespective of the initial state when the flat signal-transmission medium PS is inserted.

On the other hand, since the conductive shell 11 according to the above mentioned embodiment is formed integrally in the whole including the upper shell piece 11*a* and the lower shell piece 11*b*, adopting an intermediate step where two or more conductive shells 11 and 11, . . . are connected continuously by a carrier or the like is made to be possible. In this way, manufacturing of the conductive shell 11 is performed integrally, and thereby, the extremely efficient manufacturing becomes possible.

Although the invention made by the present inventor has been described specifically based on the embodiment as described above, the present embodiment is not limited to the above-mentioned embodiment, and it is needless to say that the present embodiment can be modified variously in the range without departing from the substance.

For example, although in the above mentioned embodiment the positioning part PS2 provided in the flat signal-transmission medium PS has been configured to be the shape projecting outward in the plate width direction, a shape depressed in the plate width direction is also possible, and a pillar-shaped one which projects in a plate thickness direction and a depressed hole shape are also possible.

In addition, although the connection terminal part (multi-electrode shape electrode part) in the above mentioned embodiment has been configured such that the ground terminal is arranged on the outside of the signal terminal, it is also possible as a matter of course that this ground terminal is configured to be the other arrangement relation to the signal terminal. In addition, a configuration having only a signal terminal where the ground terminal is removed is also possible.

Furthermore, although the retaining engaging pawl 11*c* in the above mentioned embodiment is configured to be vertically displaced elastically, it is possible to be supported so as to be able to be displaced elastically in the other direction if the direction is orthogonal to the insertion direction of the flat signal-transmission medium. For example, although in the present embodiment the retaining engaging pawl 11*c* is provided in the lower shell 11*b* so as to be displaced elastically in the plate thickness direction of the flat signal-transmission medium, the retaining engaging pawl 11*c* may be provided on the side surface of the conductive shell so as to be displaced elastically in the plate width direction of the flat signal-transmission medium.

In addition, although the above mentioned embodiment is one where the present invention is applied to a horizontally fitting type plug connector, the present invention is applicable similarly to a vertically fitting type plug connector.

As described above, it is possible that the present embodiment is applied widely to a large variety of electrical connectors used for various electric appliances.

What is claimed is:

1. A plug connector which is configured such that a terminal portion of a flat signal-transmission medium is attached to a conductive shell so as to project from the conductive shell and a first part including a terminal portion of the flat signal-transmission medium is inserted into an opposing connector, wherein a medium receiving space defined in a fixed state in which a terminal portion of the flat signal-transmission medium is inserted is formed in the conductive shell, a retaining engaging pawl which holds the flat signal-transmission medium by being engaged with a second part of the flat signal-transmission medium inserted into the medium receiving space is provided in the conductive shell, the retaining engaging pawl is supported in a manner where elastic displacement is possible in a direction orthogonal to an insertion direction of the flat signal-transmission medium, the retaining engaging pawl is displaced elastically by a second part of the flat signal-transmission medium inserted into the medium receiving space abutting on the retaining engaging pawl, the retaining engaging pawl is engaged with the second part of the flat signal-transmission medium by an elastically returning bias force of the retaining engaging pawl at that time, an abutting elastic spring part which abuts on a third part of the flat signal-transmission medium inserted into the medium receiving space of the conductive shell and is displaced elastically in the insertion direction is provided in the conductive shell, and wherein the flat signal-transmission medium is configured to be pressed against the retaining engaging pawl side by an elastically returning bias force of the abutting elastic spring part.

2. The plug connector according to claim 1, wherein a positioning part formed so as to project or become depressed in a plate width direction or a plate thickness direction of the flat signal-transmission medium is provided in the flat signal-transmission medium, and the retaining engaging pawl is configured to be engaged with the positioning part.

3. The plug connector according to claim 1, wherein a short circuit prevention part which holds the conductive shell in a non-contact state with a connection terminal of the terminal portion of the flat signal-transmission medium is provided on a surface of the conductive shell, and the short circuit prevention part is arranged so as to be faced to an insulation portion of the flat signal-transmission medium inserted into the medium receiving space.

4. The plug connector according to claim 1, wherein a sliding contact elastic spring member which abuts on a side end surface of the flat signal-transmission medium in a plate width direction and bends elastically when the flat signal-transmission medium is inserted is provided in the conductive shell.

5. A method of manufacturing a plug connector, wherein two or more bodies of conductive shells according to claim 1 are connected and manufactured integrally.

* * * * *